US008894839B2

(12) United States Patent
Ramaseshan

(10) Patent No.: US 8,894,839 B2
(45) Date of Patent: Nov. 25, 2014

(54) PROCESS, SYSTEM, AND APPARATUS FOR A HYDROCRACKING ZONE

(75) Inventor: Vinod Ramaseshan, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 856 days.

(21) Appl. No.: 12/710,128

(22) Filed: Feb. 22, 2010

(65) Prior Publication Data

US 2011/0203969 A1 Aug. 25, 2011

(51) Int. Cl.

| | |
|---|---|
| ***C10G 65/10*** | (2006.01) |
| ***C10G 47/14*** | (2006.01) |
| ***C10G 45/62*** | (2006.01) |
| ***C10G 45/52*** | (2006.01) |
| ***C10G 67/06*** | (2006.01) |

(52) U.S. Cl.

CPC ..... *C10G 67/06* (2013.01); *C10G 2300/301* (2013.01)

USPC ..... 208/58; 208/111.35; 208/143

(58) Field of Classification Search

USPC ..... 208/58, 111.35, 143

See application file for complete search history.

(56) References Cited

U.S. PATENT DOCUMENTS

| | | | | |
|---|---|---|---|---|
| 3,245,900 | A * | 4/1966 | Paterson | 208/56 |
| 4,764,266 | A * | 8/1988 | Chen et al. | 208/58 |
| 5,110,444 | A * | 5/1992 | Haun et al. | 208/89 |
| 5,461,178 | A * | 10/1995 | Harandi | 585/259 |
| 5,620,589 | A | 4/1997 | Yan | |
| 5,885,440 | A | 3/1999 | Hoehn et al. | |
| 5,980,729 | A | 11/1999 | Kalnes et al. | |
| 5,985,132 | A | 11/1999 | Hoehn et al. | |
| 6,096,191 | A | 8/2000 | Kalnes | |
| 6,106,694 | A | 8/2000 | Kalnes et al. | |
| 6,190,535 | B1 | 2/2001 | Kalnes et al. | |
| 6,190,542 | B1 | 2/2001 | Comolli et al. | |
| 6,217,746 | B1 | 4/2001 | Thakkar et al. | |
| 6,296,758 | B1 | 10/2001 | Kalnes et al. | |
| 6,328,879 | B1 | 12/2001 | Kalnes | |
| 6,361,683 | B1 | 3/2002 | Kalnes | |
| 6,379,532 | B1 | 4/2002 | Hoehn et al. | |
| 6,379,533 | B1 | 4/2002 | Thakkar et al. | |
| 6,387,245 | B1 | 5/2002 | Kalnes et al. | |
| 6,402,935 | B1 | 6/2002 | Kalnes | |
| 6,432,297 | B1 | 8/2002 | Kalnes et al. | |
| 6,444,116 | B1 | 9/2002 | Galiasso et al. | |
| 6,451,197 | B1 | 9/2002 | Kalnes | |
| 6,517,705 | B1 | 2/2003 | Kalnes et al. | |
| 6,547,956 | B1 * | 4/2003 | Mukherjee et al. | 208/58 |
| 6,596,155 | B1 | 7/2003 | Gates et al. | |
| 6,623,623 | B2 | 9/2003 | Kalnes | |
| 6,638,418 | B1 | 10/2003 | Kalnes et al. | |
| 6,702,935 | B2 | 3/2004 | Cash et al. | |
| 6,793,804 | B1 | 9/2004 | Lindsay et al. | |
| 6,858,128 | B1 | 2/2005 | Heohn et al. | |
| 7,001,503 | B1 * | 2/2006 | Koyama et al. | 208/58 |
| 7,005,057 | B1 | 2/2006 | Kalnes | |
| 7,041,211 | B2 | 5/2006 | Kalnes | |
| 7,074,321 | B1 | 7/2006 | Kalnes | |
| 7,087,153 | B1 | 8/2006 | Kalnes | |
| 7,094,332 | B1 | 8/2006 | Kalnes et al. | |
| 7,097,760 | B1 | 8/2006 | Kalnes et al. | |
| 7,108,779 | B1 | 9/2006 | Thakker | |
| 7,238,274 | B2 | 7/2007 | Turner | |
| 7,384,542 | B1 | 6/2008 | Thakkar et al. | |
| 7,419,582 | B1 | 9/2008 | Hoehn et al. | |
| 7,449,102 | B2 | 11/2008 | Kalnes | |
| 7,462,276 | B2 | 12/2008 | Wang et al. | |
| 7,470,358 | B1 | 12/2008 | Kalnes | |
| 7,547,386 | B1 | 6/2009 | Thakkar et al. | |
| 7,566,429 | B2 | 7/2009 | Buelna et al. | |
| 7,591,940 | B2 | 9/2009 | Kalnes | |
| 7,622,034 | B1 | 11/2009 | Thakkar et al. | |
| 2008/0060976 | A1 | 3/2008 | Brierley et al. | |
| 2008/0289996 | A1 | 11/2008 | Gupta et al. | |
| 2009/0065397 | A1 | 3/2009 | Hoehn et al. | |
| 2009/0095654 | A1 | 4/2009 | Gupta et al. | |

OTHER PUBLICATIONS

Abdo et al., Maximize Diesel with UOP Enhanced Two-Stage Unicracking™ Technology, 18th Annual Saudi-Japan Symposium on Catalysts in Petroleum Refining and Petrochemicals—Proceedings 2008, 2008, pp. 25-27.

Lawrence et al., Process Developments in Gasoil Hydrotreating, Hydrotreatment and Hydrocracking of Oil Fractions, 1997, vol. 106, pp. 479-484.

Maddox et al., Integrated Solutions for Optimized ULSD Economics, NPRA Annual Meeting Papers 2003, 2003, pp. 23 pages.

* cited by examiner

*Primary Examiner* — Randy Boyer

(74) *Attorney, Agent, or Firm* — James C Paschall

(57) ABSTRACT

One exemplary embodiment can be a process for a hydrocarbon feed. The process can include passing a stream through a separation zone forming a void for separating one or more gases from one or more liquids and at least partially containing a catalyst. The catalyst may include at least one group VIII noble metal. Typically, the separation zone is downstream of a hydrocracking zone for reducing the operating pressure in the hydrocracking zone.

17 Claims, 3 Drawing Sheets

PROCESS, SYSTEM, AND APPARATUS FOR A HYDROCRACKING ZONE

FIELD OF THE INVENTION

This invention generally relates to a process, system and apparatus for a hydrocarbon stream, and more particularly to a separation zone for a hydrocracking zone.

DESCRIPTION OF THE RELATED ART

A hydrocracking apparatus can treat one or more feedstocks. Often, the hydrocracking apparatus can produce multiple products. However, if the hydrocracking apparatus has to meet multiple specifications for these products, the apparatus may operate at a higher severity condition to ensure that the most rigorous product specification may be met. As an example, if the apparatus has a kerosene smoke target, the hydrogen partial pressure can be increased to meet that specification. However, such a rigorous operation may be unnecessary to meet other specifications, such as hydrotreating to meet a maximum sulfur specification or cetane number for, e.g., a diesel fuel.

In some hydrocracking units, the pressure can be set greater than about 14,000 kPa. Typically, the aromatic saturation of the kerosene can be equilibrium limited, and as such, pressure may be used to force the reaction to obtain a targeted overall aromatic saturation. However, higher pressures generally require sturdier equipment and vessels, and such higher pressure may not be required to meet other targets, such as sulfur level. Because the amount of materials, such as steel, has a direct bearing on cost, the higher system pressure generally requires a greater capital cost. Hence, an improved design that can reduce system pressure may not only provide flexibility, but reduce initial capital expenditures and operating expenses.

SUMMARY OF THE INVENTION

One exemplary embodiment can be a process for a hydrocarbon feed. The process can include passing a stream through a separation zone forming a void for separating one or more gases from one or more liquids and at least partially containing a catalyst. The catalyst may include at least one group VIII noble metal. Typically, the separation zone is downstream of a hydrocracking zone for reducing the operating pressure in the hydrocracking zone.

Another exemplary embodiment may be a system for hydroprocessing a hydrocarbon feed. The system may include a first hydrocracking zone, a first separation zone, a second hydrocracking zone, and a second separation zone. The first hydrocracking zone may produce a first hydrocracked effluent. Generally, the first separation zone produces a first stream including one or more gases and a second stream including one or more liquids. Usually, a second hydrocracking zone produces a second hydrocracked effluent. Typically, a second separation zone produces a third stream including one or more gases and a fourth stream including one or more liquids. The second separation zone can contain a catalyst including one or more group VIII noble metals.

A further exemplary embodiment may be a hydroprocessing apparatus. The apparatus can include a hydrotreating zone, a first hydrocracking zone, a first separation zone, a fractionation zone, a second hydrocracking zone, and a second separation zone. The hydrotreating zone may be adapted to receive a feed. Generally, the first hydrocracking zone is adapted to receive at least a portion of an effluent from the hydrotreating zone. Usually, a first separation zone is adapted to receive at least a portion of an effluent from the first hydrocracking zone. Furthermore, the fractionation zone can be adapted to receive at least a portion of an effluent from the first separation zone and may produce a bottom stream. Typically, a second hydrocracking zone is adapted to receive at least a portion of the bottom stream and produces an effluent. Generally, a second separation zone is adapted to receive at least a portion of the effluent from the second hydrocracking zone. The second separation zone may include a separation vessel containing a catalyst having at least one group VIII noble metal.

The embodiments disclosed herein can provide a process for reducing saturated aromatics in a kerosene product while not requiring increased pressure in an apparatus. Instead, a separation zone can include a noble metal catalyst and receive a hydrogen stream to saturate aromatics. Thus, the entire unit can have flexibility in operation to meet product specifications without requiring rigorous operation of the entire unit. Hence, increased capital expense for equipment and increased operating expenses may be avoided.

DEFINITIONS

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "rich" can mean an amount of at least generally about 50%, and preferably about 70%, by mole, of a compound or class of compounds in a stream.

As used herein, the term "substantially" can mean an amount of at least generally about 80%, preferably about 90%, and optimally about 99%, by mole, of a compound or class of compounds in a stream.

DETAILED DESCRIPTION

Figure 1:
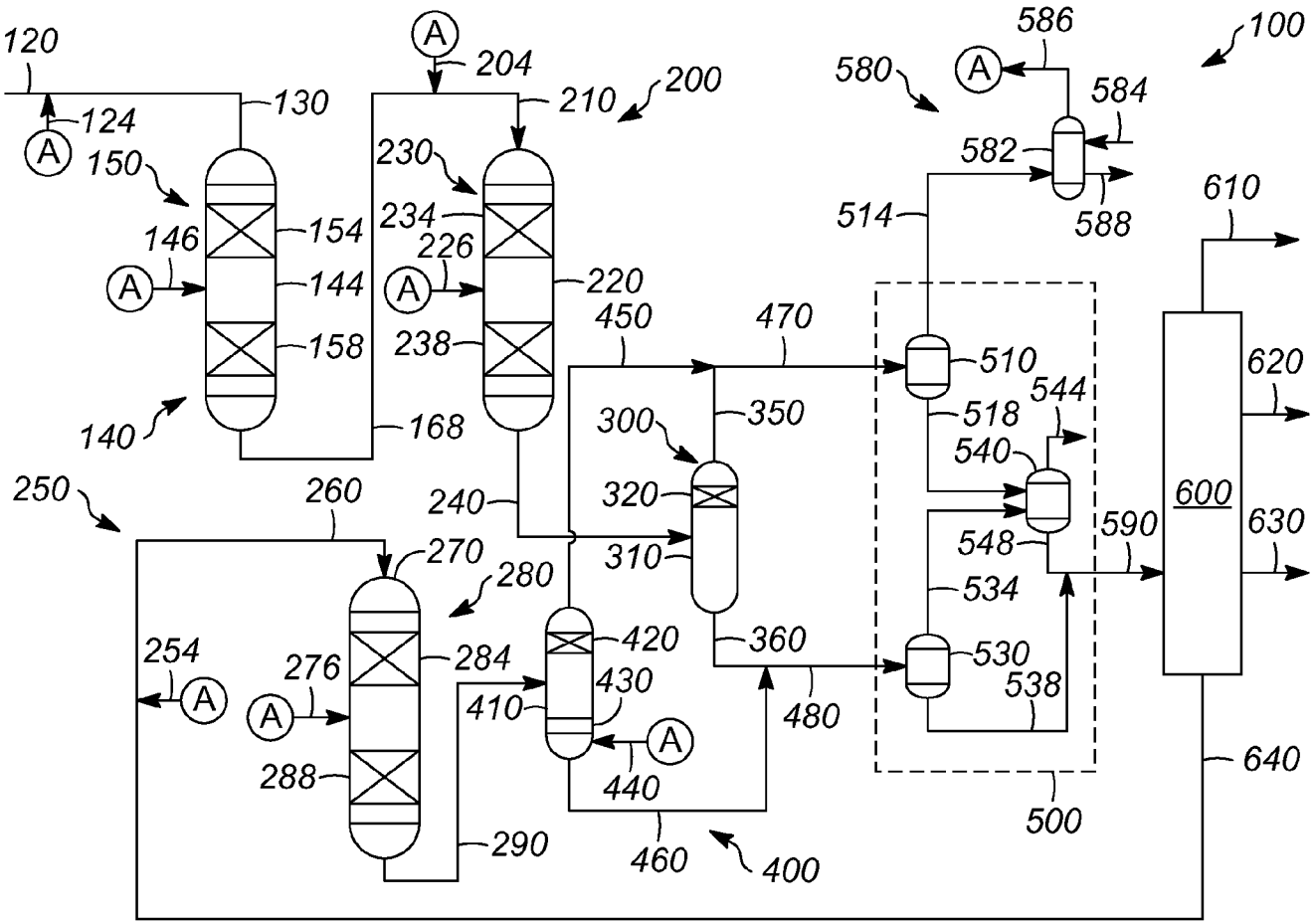
FIG. 1 is a schematic depiction of an exemplary hydroprocessing apparatus or system.

Referring to FIG. 1, a hydroprocessing apparatus or system 100 can include a hydrotreating zone 140, a first hydrocracking zone 200, a second hydrocracking zone 250, a first separation zone 300, a second separation zone 400, a flash zone 500, a scrubber zone 580, and a fractionation zone 600. The hydrotreating zone 140 can receive a hydrocarbon feed 120. Typically, the hydrocarbon feed 120 can have components boiling in the range of about 170-about 650° C. Usually, these feeds can include at least one of a vacuum gas oil, a vacuum distillation unit product, a heavy gas oil, a catalytic residue upgrading unit product, a deasphalted oil, a solvent deasphalting unit product, a cycle oil, a fluid catalytic cracking unit product, a lube oil extract, a solvent extraction lube base oil unit product, a coking unit product, and a thermal cracking unit product, such as a Visbreaking product. Typically, the hydrocarbon feed 120 can receive a stream 124 including hydrogen from "A", which can be at least a part of a hydrogen manifold as described hereinafter, to form a combined feed 130. This combined feed 130 can be provided to the hydrotreating zone 140. As depicted, process flow lines in the figures can be referred to as streams, feeds, products, or effluents. Particularly, a line can contain one or more streams, feeds, products or effluents, and one or more streams, feeds, products, or effluents can be contained by a line. Exemplary hydrotreating and hydrocracking zones are disclosed in, e.g., US 2008/0060976 A1.

Generally, the hydrotreating zone 140 can include a hydrotreating reactor 144 that can receive at least one stream 146 including hydrogen from "A" and can include at least one bed 150. Usually, the at least one bed 150 can include a first bed 154 containing a catalyst having at least one group VIII metal and at least one group VIB metal, and a second bed 158 containing a catalyst containing at least one group VIII metal and at least one group VIB metal. The at least one group VIII metal can include iron, cobalt, or nickel and the at least one group VIB metal can include molybdenum or tungsten. Generally, these metals are included on a support material, such as silica or alumina. Usually, the group VIII metal can be present in the amount of about 2-about 20%, by weight, based on the weight of the catalyst, and the group VIB metal can be present in an amount of about 1-about 25%, by weight, based on the weight of the catalyst.

Typically, the hydrotreating zone 140 can be operated at a temperature of about 200-about 500° C. and a pressure of about 3.5-about 20.8 MPa. Although the hydrogen stream 146 is depicted being provided at the top of the reactor 144, it should be understood that the hydrogen stream 146 can be provided anywhere along the hydrotreating reactor 144 and multiple hydrogen streams may be provided. Afterwards, a hydrotreated effluent 168 can exit the hydrotreating reactor 144. At least a portion of the effluent 168 can combine with a stream 204 including hydrogen from "A" to form a combined feed 210 to the first hydrocracking zone 200.

The first hydrocracking zone 200 can include a first hydrocracking reactor 220 having at least one bed 230. The first hydrocracking reactor 220 can receive a stream 226 including hydrogen from "A". Although one stream 226 including hydrogen is depicted, it should be understood that multiple streams may be provided to the first hydrocracking reactor 220. The at least one bed 230 can include a first bed 234 containing a catalyst including at least one group VIII metal and at least one group VIB metal, and a second bed 238 containing a catalyst including at least one group VIII metal and at least one group VIB metal. The at least one group VIII metal can include iron, cobalt, or nickel and the at least one group VIB metal can include molybdenum or tungsten. Typically, the amount of the metals can be about 0.05-about 30%, by weight, based on the weight of the catalyst. The first hydrocracking zone 200 can operate at any suitable condition, such as a temperature of about 200-about 500° C. and a pressure of about 3.5-about 21 MPa. At least a portion of an effluent 240 from the first hydrocracking zone 200 can pass to a first separation zone 300.

The first separation zone 300 can include a first separation vessel 310 with a hydrogenation zone 320. The hydrogenation zone 320 can include a catalyst of molybdenum and nickel or cobalt as base metals on any suitable support, such as alumina or silica, to prevent mercaptan recombination in the naphtha product range. Preferably, the catalyst does not contain a noble metal due to the presence of one or more sulfur compounds that may poison the noble metal.

A first stream 350 including one or more gases can exit the first separation vessel 310 as well as a second stream 360 including one or more liquids. The stream 350 can be combined with a third stream 450, as described hereinafter, to form a combined stream 470. Similarly, the liquid stream 360 can be combined with a fourth stream 460, as described hereinafter, to form a stream 480.

The streams 470 and 480 can enter the flash zone 500. The flash zone 500 can include a first flash drum 510, a second flash drum 530, and a third flash drum 540. Typically, the flash drums 510, 530, and 540 can separate gases from liquids. Particularly, the first flash drum 510 can provide an overhead stream 514 including one or more gases and a bottom stream 518 including one or more liquids. Similarly, the second flash drum 530 can provide an overhead stream 534 including one or more gases and a bottom stream 538 including one or more liquids. The overhead stream 534 and the bottom stream 518 can be received in the third flash drum 540. The third flash drum 540 can provide an overhead stream 544 including one or more gases that can be sent to any suitable destination, such as a flare or fuel gas, while the bottom stream 548 including one or more liquids can be combined with the bottom stream 538. These combined streams 538 and 548 may be provided as a feed 590, which can include at least a portion of the stream 360, to the fractionation zone 600.

Generally, the fractionation zone 600 can produce a variety of products, and can include an overhead stream 610, a first side-stream 620, a second side-stream 630, and a bottom stream 640. Typically, the first side-stream 620 can include kerosene and the second side-stream 630 can include diesel. The kerosene can have a product specification, such as a smoke point, while the diesel product can have a product specification, such as a maximum sulfur target and minimum cetane target.

The flash zone 500 can provide the overhead stream 514, which can in turn be provided to a scrubber zone 580. The scrubber zone 580 can include a scrubber 582 and receive a stream 584 including a scrubbing fluid that can exit as a bottom liquid stream 588. The scrubbing fluid can be provided from any suitable unit and can include methyl diethyl amine and diethanol amine from an amine treating unit. Generally, the stream 514 can contain suitable levels of hydrogen and be recycled after being scrubbed in the scrubber 582 and exit as an overhead stream 586. Typically, the overhead stream 586 can be recycled to the hydrogen manifold "A". Usually, the hydrogen manifold can include a plurality of lines or pipes that can receive a variety of streams containing hydrogen, including make-up hydrogen from a hydrogen generation unit, and be provided to various processes in a refinery or chemical manufacturing plant.

Referring to the fractionation zone 600, at least a portion of the bottom stream 640 can be provided to the second hydrocracking zone 250. Typically, the bottom stream 640 is combined with a hydrogen stream 254 from "A" to form a combined feed 260. The second hydrocracking zone 250 can include a second hydrocracking reactor 270 that may receive at least one stream 276 from "A" including hydrogen. Generally, the second hydrocracking reactor 270 can receive several hydrogen streams at any suitable location. The second hydrocracking reactor 270 can include at least one bed 280 including a first bed 284 and a second bed 288. Typically, each of the first bed 284 and second bed 288 can contain a catalyst including at least one group VIII metal and at least one group VIB metal. The group VIII metal can include at least one of iron, cobalt, nickel, ruthenium, rhodium, palladium, osmium, iridium, and platinum. The at least one group VIB metal can include at least one of molybdenum and tungsten. Preferably, the group VIII metal can be iron, cobalt, or nickel, and the group VIB metal may be molybdenum or cobalt. Typically, the amount of the metals can be about 0.05-about 30%, by weight, based on the weight of the catalyst. If a noble metal is included, the catalyst may contain about 0.01%-about 5%, by weight, noble metal based on the weight of the catalyst. The second hydrocracking reactor 270 can operate at a temperature of about 200-about 500° C., a pressure of about 3.5-about 21 MPa, and a liquid hourly space velocity of about 1-about 3 $hr^{-1}$, preferably about 2 $hr^{-1}$. The second hydrocracking reactor 270 can provide at least a portion of a stream or an effluent 290 to the second separation zone 400.

The second separation zone 400 can operate at any suitable temperature and pressure, typically a temperature of about 220-about 380° C. and a pressure of about 3,500-about 17,300 kPa. The second separation zone 400 can include a second separation vessel 410 that may receive a stream 440 including hydrogen from "A". Generally, the stream 440 includes an effective amount of hydrogen to saturate one or more aromatics, and optionally one or more sulfur compounds.

Figure 2:
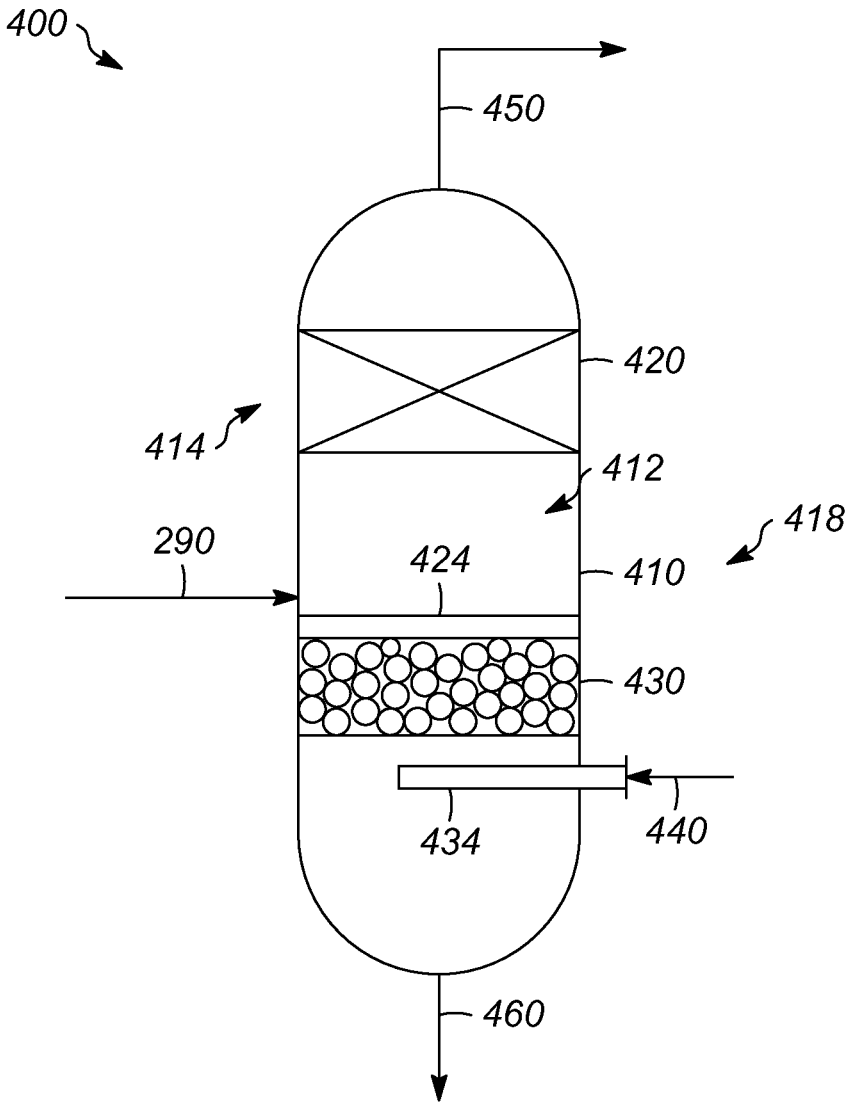
FIG. 2 is a schematic, cross-sectional depiction of an exemplary second separation zone.

Referring to FIG. 2, the second separation vessel 410 can form a void 412 with an upper portion 414 and a lower portion 418. Generally, the upper portion 414 and the lower portion 418 can form two separate chambers within the second separation vessel 410 allowing fluid communication between the portions 414 and 418, as in FIG. 2. Typically, the lower portion 418 can include a packing 430, which can be mesh or one or more rings. In the upper portion 414, the hydrogenation zone 420 can include a catalyst including any suitable group VIII noble metal, such as platinum and/or palladium optionally provided on a support, such as a silica-alumina or an alumina. The catalyst may contain about 0.01%-about 5%, by weight, noble metal based on the weight of the catalyst.

Typically, the effluent 290 enters the lower portion 418 and is distributed over a tray 424. The tray 424 typically forms one or more openings, and may include other devices to facilitate the distribution of liquid. The liquid from the tray 424 may be stripped with hydrogen from the stream 440 rising through the packing 430. The stream 440 can be provided to the separation vessel 410 and pass through a distributor 434 underneath the packing 430. The distributor 434 can be a pipe with a series of holes formed about its circumference and extending along a length of the pipe. The heavier liquid can drop down and exit as a fourth stream or effluent 460. Stripped gases may rise and pass from the lower portion 418 to the upper portion 414 and through the hydrogenation zone 420. The gases can then exit the second separation vessel 400 as a third stream or effluent 450 including one or more gases, typically saturated components boiling in the kerosene range. The second separation vessel 410 can operate at a temperature of about 220-about 380° C., a pressure of about 3.5-about 17,300 kPa, and a liquid hourly space velocity of about 8-about 10 $hr^{-1}$. Afterwards, the stream 450 can combine with the stream 350, as described above, to form the stream 470, and the stream 460 can combine with the stream 360 to form the stream 480, as described above. Generally, the second hot stage separation vessel 410 can differ from the first hot stage separation vessel 310 by the inclusion of an aromatic saturation catalyst and adaptation for the intake of a hydrogen stream.

Figure 3:
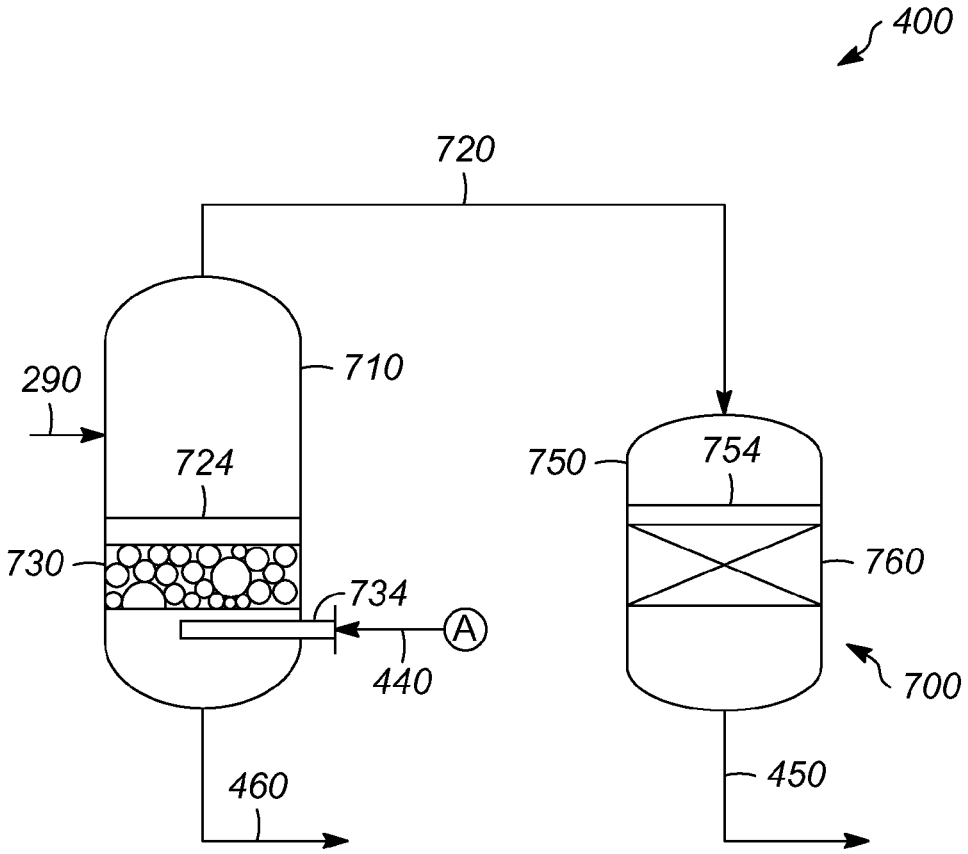
FIG. 3 is a schematic, cross-sectional depiction of another exemplary second separation zone.

Referring to FIG. 3, an alternative embodiment for, e.g., a wide boiling distillate material, the second separation zone 400 can include a plurality of vessels 700. In one such version, a first vessel 710 can receive the effluent 290 that may distribute over a tray 724, similar as the tray 424, as described above. The stream 440 including hydrogen from "A" may enter the first vessel 710 and pass through a distributor 734, which may be similar to the distributor 434, as described above. The effluent 290 can intermix with the hydrogen from the stream 440 passing through a packed bed 730, similar to the packed bed 430, as described above. Generally, the heavier liquid drops down and exits as a stream 460. The stripped one or more fluids can then exit at the top as a stream 720 and pass to a second vessel 750.

The one or more fluids in the stream 720 may pass downward through a tray 754 and a hydrogenation zone 760. The tray 754 can be similar to the tray 424 and the hydrogenation zone 760 can be similar to the hydrogenation zone 420, as described above. The operating conditions for the separation zone 400 can be similar as described above for the vessel 410. The saturated product can exit as a stream 450 and pass to the flash zone 500, as described above.

The embodiments disclosed herein can provide a higher aromatic reduction at the second stage as compared to the first stage to meet the kerosene smoke point, and thus provide flexibility to operate the system 100 at a lower pressure and still meet product specifications for distillate products and unconverted oil. Hence, a pressure below about 13,000 kPa may be obtained depending on feed quality and target conversion specifications, such as a pressure of about 700-about 2,100 kPa. In some preferred embodiments, the pressure in the apparatus or system 100, such as the flash zone 500, particularly the first flash drum 510, can be reduced by at least about 4%, or even at least about 5%, due to the embodiments disclosed herein. Moreover, it is advantageous placing noble metal catalyst in the second separation zone 400 to avoid sulfur poisoning as sulfur is significantly removed by the upstream hydrotreating and hydrocracking zones. Typically, the second hydrocracking reactor 270 can have a volume of about 5:1-about 10:1, typically about 7:1, as compared to the second separation vessel 410. As a consequence, including a noble metal in the second hydrocracking reactor 270 can be prohibitively expensive. Thus, providing the noble metal catalyst in the second separation vessel 410 can be a more attractive alternative for controlling saturating aromatics for meeting a specification, such as a smoke target for kerosene.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for a hydrocarbon feed, comprising:

A) providing a feed to a first hydrocracking zone;

B) passing at least a portion of an effluent from said first hydrocracking zone to a fractionation zone;

C) providing at least a portion of a bottom stream from said fractionation zone to a second hydrocracking zone; and D) passing a stream through a separation zone forming a void for separating one or more gases from one or more liquids and at least partially containing a catalyst comprising at least one group VIII noble metal for saturating aromatics; wherein the separation zone is downstream of the second hydrocracking zone.

2. The process according to claim 1, wherein the separation zone further comprises a separation vessel wherein the separation vessel has an upper portion and a lower portion with the upper portion containing the at least one group VIII noble metal catalyst that the one or more gases pass upwards there-through.

3. The process according to claim 2, wherein the lower portion contains a packing.

4. The process according to claim 3, wherein the packing comprises one or more rings.

5. The process according to claim 1, wherein the second hydrocracking zone comprises a catalyst comprising at least one group VIII metal and at least one group VIB metal.

6. The process according to claim 5, wherein the group VIII metal comprises at least one of iron, cobalt, and nickel, and the group VIB metal comprises at least one of molybdenum and tungsten.

7. The process according to claim 1, wherein the at least one noble metal comprises at least one of platinum and palladium.

8. The process according to claim 1, wherein the separation zone operates at a pressure of about 3,500-about 17,300 kPa and a temperature of about 220-about 380° C.

9. The process according to claim 2, further comprising communicating a stream comprising hydrogen to the separation vessel.

10. The process according to claim 1, wherein the hydrocarbon feed comprises components boiling in the range of about 170-about 650° C.

11. The process according to claim 1, further comprising distilling at least a portion of an effluent from the separation zone to produce at least two distilled products.

12. A process for a hydrocarbon feed, comprising:

A) providing a feed to a first hydrocracking zone;

B) passing at least a portion of an effluent from said first hydrocracking zone to a fractionation zone;

C) providing at least a portion of a bottom stream from said fractionation zone to a second hydrocracking zone; and D) passing a stream through a separation zone forming a void for separating one or more gases from one or more liquids and at least partially containing a catalyst comprising about 0.01%-about 5%, by weight of at least one group VIII noble metal for saturating aromatics; wherein the separation zone is downstream of the second hydrocracking zone.

13. The process according to claim 12, wherein the separation zone further comprises a separation vessel wherein the separation vessel has an upper portion and a lower portion with the upper portion containing the at least one group VIII noble metal catalyst that the one or more gases pass upwards there-through.

14. The process according to claim 13, wherein the lower portion contains a packing.

15. A process for a hydrocarbon feed, comprising:

A) providing a feed to a first hydrocracking zone;

B) passing at least a portion of an effluent from said first hydrocracking zone to a fractionation zone;

C) providing at least a portion of a bottom stream from said fractionation zone to a second hydrocracking zone;

D) passing an effluent stream from said second hydrocracking zone through a separation zone forming a void for separating one or more gases from one or more liquids and at least partially containing a catalyst comprising at least one group VIII noble metal for saturating aromatics; wherein the separation zone is downstream of a second hydrocracking zone, wherein the separation zone further comprises a separation vessel; and E) distilling at least a portion of an effluent from the separation zone to produce at least two distilled products.

16. The process according to claim 15, wherein the separation zone further comprises a separation vessel wherein the separation vessel has an upper portion and a lower portion with the upper portion containing at least one group VIII noble metal catalyst that the one or more gases pass upwards there-through.

17. The process according to claim 16, wherein the lower portion contains a packing.

* * * * *